United States Patent [19]

Sakakibara et al.

[11] Patent Number: 4,475,485

[45] Date of Patent: Oct. 9, 1984

[54] ENGINE COOLING SYSTEM CONTROL APPARATUS

[75] Inventors: Yoshiyasu Sakakibara, Anjo; Keiichi Fukumura, Kariya, both of Japan

[73] Assignee: Nippondenso Co., Ltd., Kariya, Japan

[21] Appl. No.: 457,282

[22] Filed: Jan. 11, 1983

[30] Foreign Application Priority Data

Jan. 19, 1982 [JP] Japan ..... 57-6937

[51] Int. Cl.[3] ..... F01P 5/12; F01P 7/16

[52] U.S. Cl. ..... 123/41.05; 123/41.1; 123/41.12; 123/41.44

[58] Field of Search ..... 123/41.08, 41.09, 41.1, 123/41.11, 41.12, 41.04, 41.05, 41.44

[56] References Cited

U.S. PATENT DOCUMENTS 4,348,990 9/1982 Nolte et al. ..... 123/41.12
4,381,736 5/1983 Hirayama ..... 123/41.44

FOREIGN PATENT DOCUMENTS 392825 5/1933 Belgium .
3024209 1/1981 Fed. Rep. of Germany .
2455174 11/1980 France ..... 123/41.12
750116 7/1980 U.S.S.R. ..... 123/41.05
38556 10/1980 U.S.S.R. .

OTHER PUBLICATIONS

Abstract of Japanese Patent 57-140511 (8/31/82).

*Primary Examiner*—William A. Cuchlinski, Jr.
*Attorney, Agent, or Firm*—Cushman, Darby & Cushman

[57] ABSTRACT

A cooling system control apparatus includes an electronic control unit to individually control the operation of an engine water pump, a radiator fan motor and an electromagnetic valve for bypassing the cooling water passage to the radiator, on the basis of a cooling water temperature. When the cooling water temperature is below about 85° C., the water pump is stopped to raise the cooling water temperature rapidly, and when the cooling water temperature is above about 85° C., the water pump is operated and the electromagnetic valve is operated to bypass the cooling water passage to the radiator, and when the cooling water temperature is above about 90° C., the fan motor is operated and also the electromagnetic valve is operated to allow the cooling water to pass through the radiator.

10 Claims, 3 Drawing Figures

ENGINE COOLING SYSTEM CONTROL APPARATUS

FIELD OF THE INVENTION

This invention relates to a cooling system control apparatus for water-cooled engines.

BACKGROUND OF THE INVENTION

With water-cooled engines used on automobiles or the like, it has been the practice that the engine cooling water temperature is controlled by means of a thermostat for controlling the amount of cooling water to the radiator, a radiator cooling motor-driven fan or the like. However, the requirements for the reduced warm-up period during the winter season, etc., have not been met satisfactorily.

SUMMARY OF THE INVENTION

It is therefore the primary object of this invention to improve the control of the cooling water flow to the radiator of an engine and reduce the warm-up period of the engine.

In accordance with the invention an electrically controlled valve unit is provided as a valve for controlling the amount of cooling water to the radiator of an engine and the valve unit and a radiator cooling motor-driven fan are automatically controlled minutely thereby reducing the warm-up period of the engine.

BRIEF DESCRIPTION OF THE DRAWINGS

The invention will become readily apparent from the following description taken in conjunction with the accompanying drawings, in which.

DETAILED DESCRIPTION OF THE INVENTION

Figure 1:
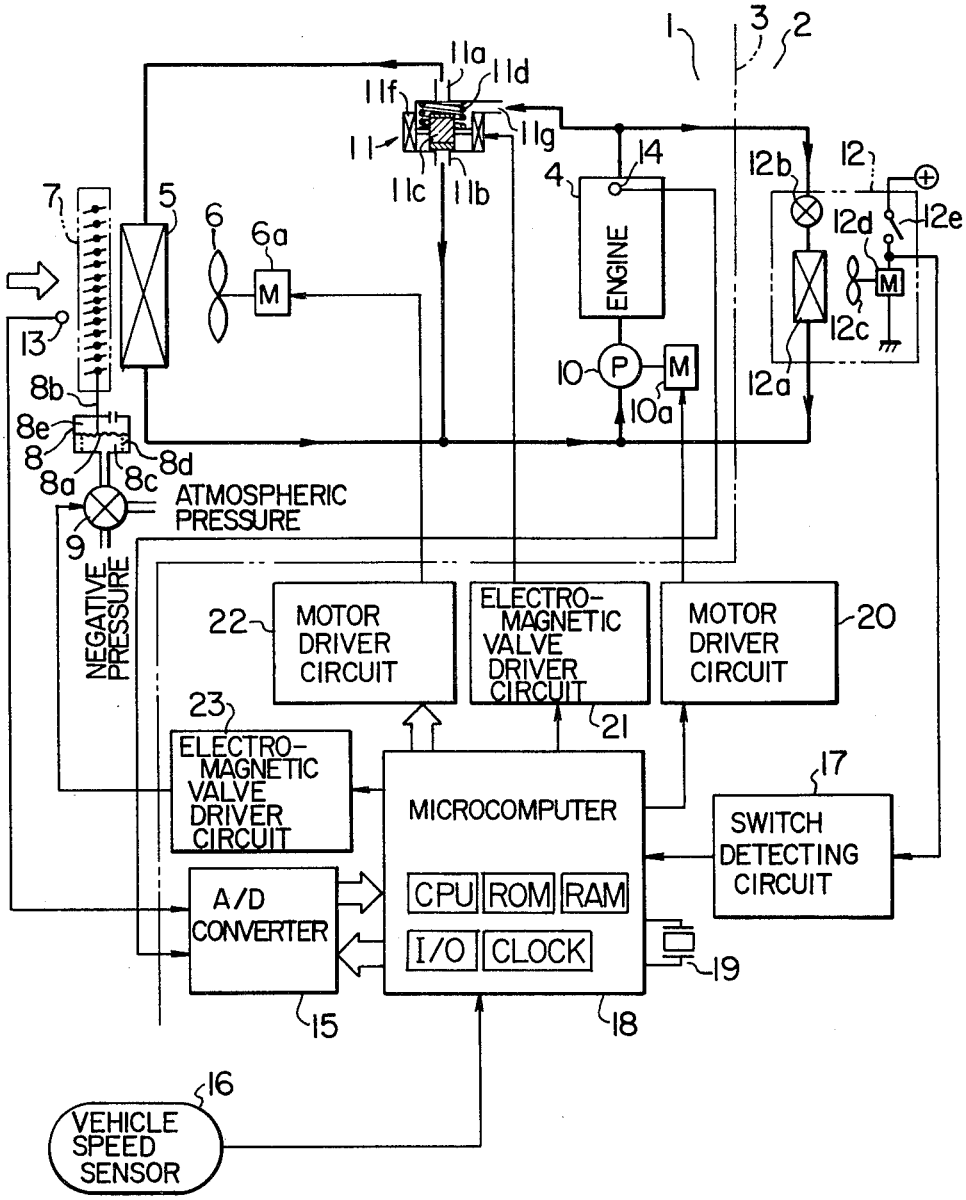
FIG. 1 is a schematic block diagram showing a control system of a whole apparatus according to an embodiment of the invention.

The invention will now be described in greater detail with reference to the accompanying drawings. In the drawings showing an embodiment of the invention which is applied to the water-cooled engine of an automobile, numeral 1 designates the engine room of the automotive vehicle, 2 a vehicle compartment, 3 a dash board separating the engine room 1 from the vehicle compartment 2, 4 a water-cooled engine for driving the vehicle, 5 a radiator for cooling the engine cooling water, and 6 a radiator cooling motor-driven fan which is driven by a motor 6*a*. Numeral 7 designates a radiator shutter arranged at the air inlet of the radiator 5 to open and close the air inlet of the radiator 5. Numeral 8 designates a shutter drive which in this embodiment comprises a diaphragm actuator constructed so that the displacement of a diaphragm 8*a* is transmitted to the shutter 7 through a shaft 8*b* to open and close the shutter 7. Numeral 8*d* designates a diaphragm return spring, and 8*e* an atmospheric chamber. Numeral 9 designates an electromagnetic valve for selectively introducing the negative pressure (the intake negative pressure of the engine 4) and the atmospheric pressure into a control pressure chamber 8*c* of the shutter drive 8. Numeral 10 designates a motor-driven water pump which is driven by a motor 10*a* to forcibly circulate the engine cooling water.

Numeral 11 designates a valve unit for controlling the amount of engine cooling water supplied to the radiator 5 and in this embodiment the valve unit 11 is of the electromagnetic valve type comprising a radiator-side passage 11*a*, a radiator bypassing passage 11*b*, a valve member 11*c* made of a magnetic material for opening and closing the passages 11*a* and 11*b*, a spring 11*d* for pressing the valve member 11*c* into the illustrated position, an energization coil 11*f* for attracting the valve member 11*c* to the side of the passage 11*a* against the spring 11*d*, and an engine-side passage 11*g* which is always communicated with the cooling water outlet of the engine 4.

Numeral 12 designates a vehicle heating system comprising an air heating heater core 12*a*, a hot water valve 12*b* for controlling the flow of hot water to the heater core 12*a*, a blower fan 12*c* for supplying the hot air heated by the heater core 12*a* into the vehicle compartment 2, a motor 12*d* for operating the fan 12*c* and a fan switch 12*e* for switching on and off the current flow to the motor 12*d*.

Numeral 13 designates an outside air sensor which in this embodiment comprises a thermistor and is positioned at the air inlet side of the shutter 7.

Numeral 14 designates a water temperature sensor for detecting the temperature of the engine cooling water and in this embodiment the sensor 14 comprises a thermistor positioned at the cooling water outlet of the engine 4.

Numeral 15 designates an A/D converter for sequentially converting the signals from the outside air sensor 13 and the water temperature sensor 14 to digital signals, 16 a vehicle speed sensor for generating vehicle speed pulses having a frequency proportional to the running speed of the vehicle, and 17 a switch detecting circuit for detecting the operating condition of the fan switch 12*e*.

Numeral 18 designates a microcomputer for performing software digital computational operations in accordance with a predetermined control program and it comprises as its main components a CPU, an ROM, an RAM, an I/O circuit section, a clock generator, etc. The microcomputer 18 is connected to a crystal unit 19 and it comes into operation in response to the supply of a stabilized voltage of 5 V from a vehicle battery (not shown) via a stabilized power supply circuit (not shown) thereby repeatedly performing the operations which will be described later and generating various command signals for controlling the fan motor 6*a*, the pump motor 10*a*, the electromagnetic valve 9 and the valve unit 11.

Numeral 20 designates a motor driver circuit for receiving the ON or OFF command from the microcomputer 18 to operate or stop the pump motor 10*a*, 21 an electromagnetic valve driver circuit responsive to the ON command from the microcomputer 18 to energize the energization coil 11*f* and responsive to the OFF command to deenergize the coil 11*f*, 22 a motor driver circuit for receiving the digital actuation command from the microcomputer 18, subjecting the same to D/A conversion and operating the fan motor 6*a* in accordance with the D/A-converted analog signal, and 23 an electromagnetic valve driver circuit for receiving the ON or OFF command from the microcomputer 18 to turn on or off the electromangetic valve 9.

Figure 2:
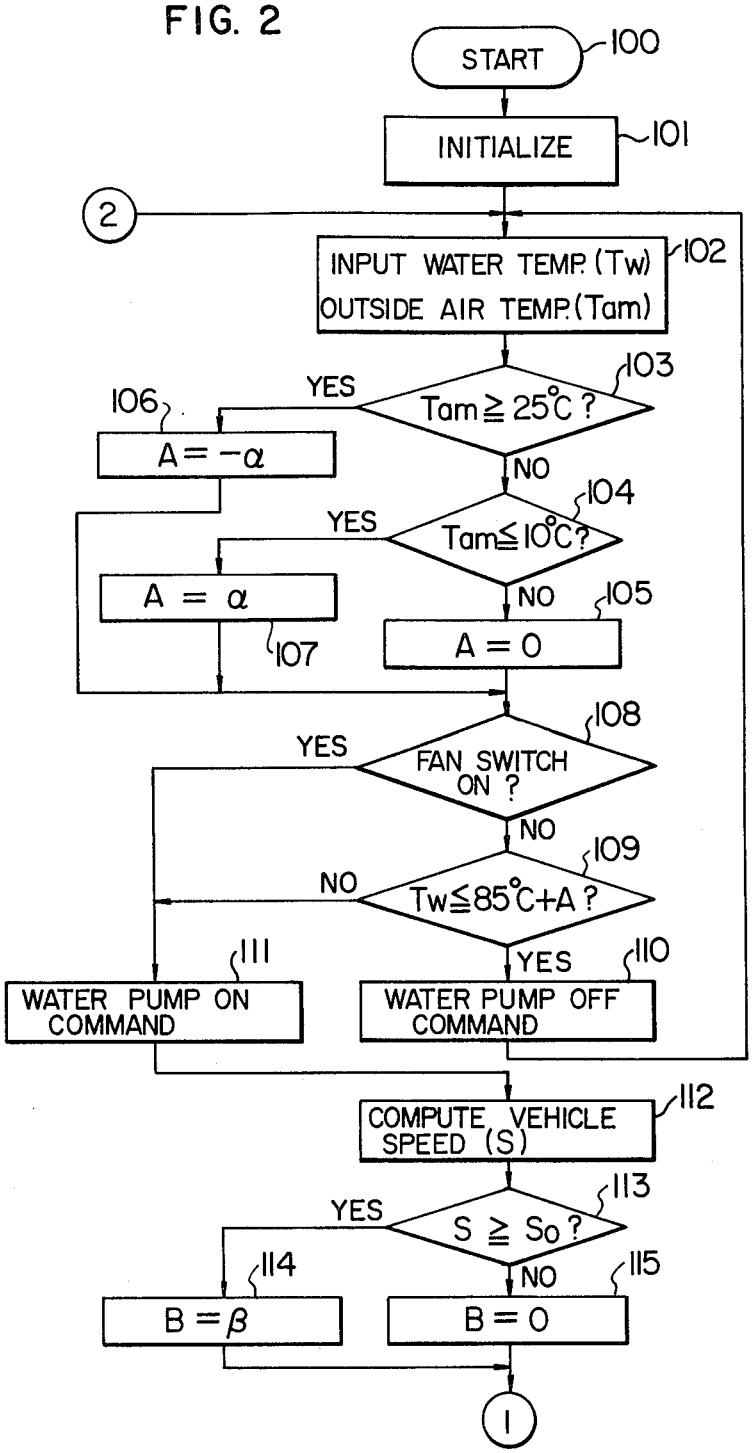
FIGS. 2 and 3 are flow charts useful for explaining the operation of the apparatus.
Figure 3:
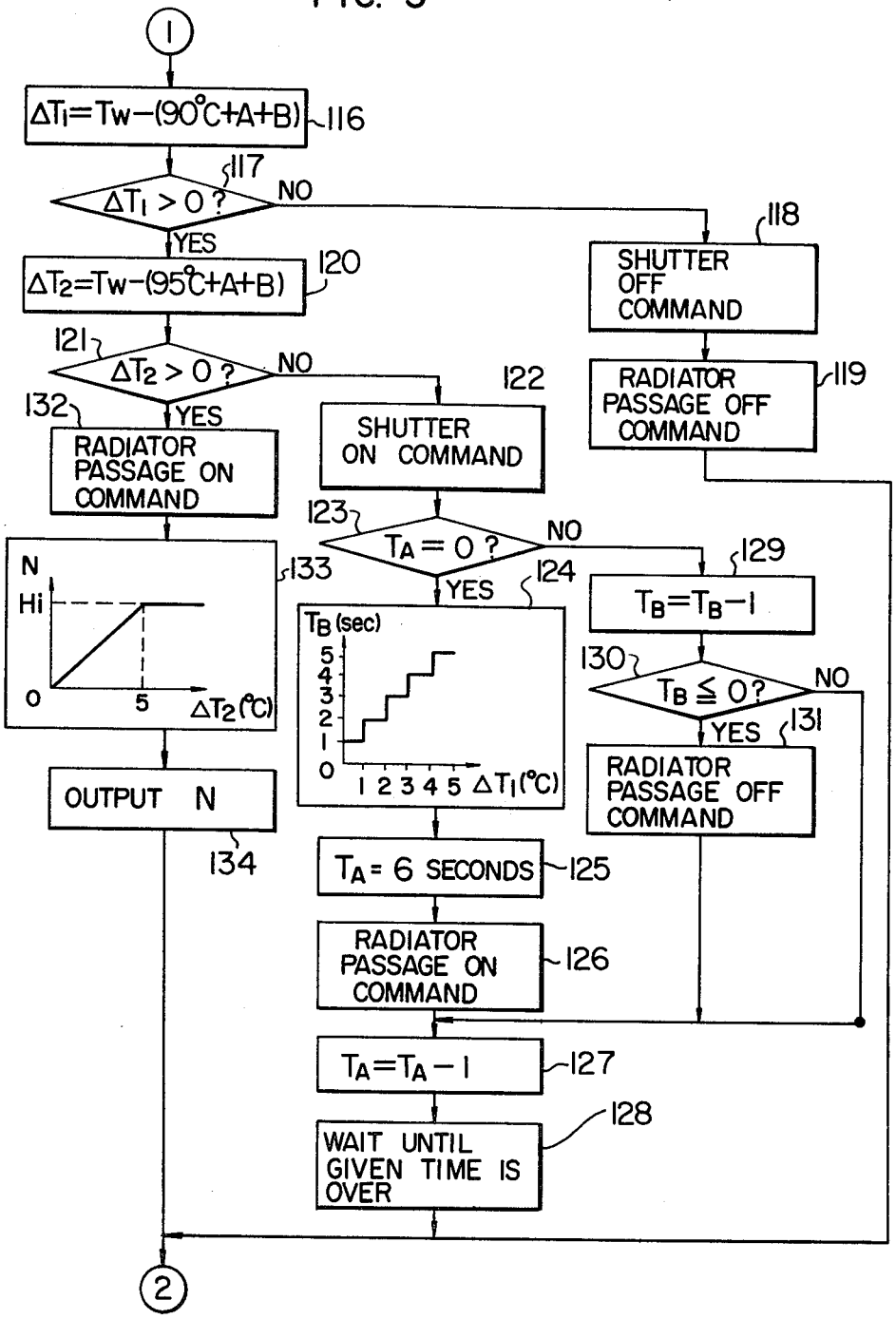

With the construction described above, the operation of the embodiment will now be described with reference to the flow charts of FIGS. 2 and 3.

Now, with the vehicle equipped with the component parts shown in FIG. 1, when the vehicle key is closed to an accessary (ACC) terminal or an ignition (IG) terminal to start the vehicle, the respective electric systems come into operation. On the other hand, the microcomputer 18 comes into operation in response to the supply of the 5-V stabilized voltage from the stabilized power supply circuit and its processing is started by a step 100 of FIG. 2. Then the processing proceeds to a step 101 so that the registers, counters, latches, etc., of the microcomputer 18 are set to their intial states (the initialize step includes the operation of setting an elapsed time computing timer to a given value and setting a first timer data $T_A$ to zero as will be described later), and also the microcomputer 18 applies an OFF command to the motor driver circuit 20 to stop the pump motor 10*a*, an ON command (hereinafter referred to as a radiator passage OFF command) to the electromagnetic valve driver circuit 21 to energize the energization coil 11*f*, a signal to the motor driver circuit 22 to stop the fan motor 6*a* and an ON command (hereinafter referred to as a shutter OFF command) to the electromagnetic valve driver circuit 23 to turn on the electromagnetic valve 9. When this initialization takes place, the pump motor 10*a* is held at rest and thus the water pump 10 is not operated. On the other hand, the energization of the energization coil 11*f* attracts the valve member 11*c* so that the radiator-side passage 11*a* is closed (the radiator bypassing passage 11*b* is communicated with the engine-side passage 11*g*), and the fan motor 6*a* is not operated. Also the electromagnetic valve 9 is turned on so that the negative pressure is supplied to the shutter driver unit 8 and the shutter 7 is closed.

After the completion of the initialization, the processing proceeds to a step 102 so that the A/D converter 15 is controlled to input data $T_W$ and $T_{am}$ obtained by A/D conversion of the signals from the outside air temperature sensor 13 and the water temperature sensor 14. The value of an outside air temperature constant A is determined by the following steps 103 to 107 in accordance with the value of the outside air temperature data $T_{am}$. In other words, if the value of the outside air temperature data $T_{am}$ is over 25° C., the decision of the step 103 becomes YES and the processing proceeds to the step 106 and the outside air temperature constant A is set to $-\alpha$ ($\alpha$ is a value corresponding to about 1.5° C.). If the value of the outside air temperature data $T_{am}$ is lower than 10° C., the decision of the step 103 becomes NO and the decision of the step 104 becomes YES. Thus, the processing proceeds to the step 107 and the outside air temperature constant A is set to $\alpha$. If the value of the outside air temperature data $T_{am}$ is in the range from 10° C. to 25° C., the decisions of the steps 103 and 104 become NO and the processing proceeds to the step 105 thereby setting the outside air temperature constant A to zero. The thus set outside air temperature constant A is used as a correction factor for the decision level of decision steps 109, 117 and 121 which will be described later.

At this time, if the engine cooling water temperature is low enough so that there is a relation $T_W \leqq 85°$ C.+A and if the fan switch 12*e* is off, the switch detecting circuit 17 generates an off-state signal and the decision of a step 108 becomes NO. Then, the processing proceeds to the next step 109 so that its decision becomes YES due to the relation $T_W \leqq 85°$ C.+A and the processing proceeds to a step 110. Thus, an OFF command (water pump OFF command) for stopping the pump motor 10*a* is applied to the motor driver circuit 20 (at this time the OFF command has already been generated by the initialization and thus the command has no bearing on the condition of the pump motor 10*a*) and the processing returns to the step 102. Thereafter, the above-mentioned operations are performed repeatedly. As a result, the water pump 10 is not opeated and practically no engine cooling water flows. Also, at this time the motor driven fan 6 is off and the radiator shutter 7 is closed. Thus, the air flow into the engine room 1 is practically stopped and therefore the engine cooling water temperature rises rapidly in a short time after the starting of the engine.

Thereafter, if the fan switch 12*e* is closed so that the decision of the step 108 becomes YES or the engine cooling water temperature rises so that there results a relation $T_W > 85°$ C.+A and the decision of the step 109 becomes NO while the above-mentioned operations are being performed repeatedly, the processing proceeds to a step 111 and an ON command (water pump ON command) is applied to the motor driver circuit 20 to operate the pump motor 10*a*. As a result, the water pump 10 is operated.

Then, the processing proceeds to a step 112 and a vehicle speed data S is computed in accordance with the vehicle speed pulses from the vehicle speed sensor 16. Then, the next step 113 determines whether the vehicle speed data S is greater than a given value $S_o$ (e.g., a value corresponding to 25 Km) so that if it is greater than the value $S_o$, the processing proceeds to a step 114 and a vehicle speed constant B is set to $\beta$ (a value corresponding to about 1.5° C.). If $S < S_o$, the vehicle speed constant B is set to zero. This set vehicle speed constant B is used as a correction factor for the decision level of the decision steps 117 and 121 to be described later. Then, the processing proceeds to a step 116 of FIG. 3 so that a first deviation $\Delta T_1$ is computed from an equation $\Delta T_1 = T_W - (90°\ C. + A + B)$ and the next step 117 determines whether the first deviation $\Delta T_1$ is a positive value. Just after the start of the water pump 10, the water temperature data $T_W$ is about 85° C.−A at the maximum and its decision necessarily becomes NO. Thus, the processing proceeds to a step 118 and a shutter OFF command is applied to the electromagnetic valve driver circuit 23. Then, the processing proceeds to a step 119 so that a radiator passage OFF command is applied to the electromagnetic valve driver circuit 21 (the corresponding commands have already been generated by the initialization and thus the generation of these commands do not change the outputs of the corresponding driver circuits), and then the processing returns to the step 102 of FIG. 2. Thereafter, the above-mentioned operations are performed repeatedly so that the water pump 10 is operated and the engine cooling water is circulated from the engine-side passage 11*g* through the radiator bypassing passage 11*b*. In this case, if the hot water valve 12*b* of the heating system is open, the cooling water is also passed to the side of the heater core 12.

Thereafter, when the temperature of the engine cooling water increases further so that the water temperature data $T_W$ exceeds the sum of a value corresponding to 90° C., the outside air temperature constant A and the vehicle speed constant B, the first deviation $\Delta T_1$ changes to a positive value and the decision of the step 117 becomes YES. Thus, the processing proceeds to a step 120 so that a second deviation $\Delta T_2$ is computed from an equation $\Delta T_2 = T_W - (95° C. + A + B)$ and a transfer is made to the next step 121 which in turn determines whether the second deviation $\Delta T_2$ is a positive value. At this time, the water temperature data $T_W$ is just slightly more than the value of 90° C.+A+B and the decision of the step 121 becomes NO. Thus, a transfer is made to a step 122 and a command for turning off the electromagnetic valve (a shutter ON command) is applied to the electromagnetic valve driver circuit 23. When this occurs, the shutter 7 is opened and the outside air flows through the engine room 1 via the radiator 5.

Then, a transfer is made to a step 123 which determines whether a first timer data $T_A$ is zero. Since the first timer data $T_A$ has been set to zero by the initialization, the decision of the step 123 becomes YES and a transfer is made to a step 124 which in turn sets a second timer data $T_B$ in response to the first deviation $\Delta T_1$ in accordance with the illustrated characteristic relation (the data $T_B$ is set to a value obtained by dividing the corresponding seconds on the abscissa of the graph by the period of the repetitive computation) and transfers to a step 125. The step 125 sets the first timer data $T_A$ to a value corresponding to a time of six seconds (the value obtained by dividing the time of six seconds by the period of the repetitive computation) and transfers to a step 126 thereby applying to the electromagneitc valve driver circuit 21 an OFF command for releasing the current flow to the energization coil **11*f* (hereinafter referred to as a radiator passage ON command). As a result, the engine-side passage 11*g* and the radiator-side passage 11*a* communicate with each other and the engine cooling water is passed through the radiator 5**.

Then, a transfer is made to a step 127 which subtracts a constant of 1 from the first timer data $T_A$ and transfers to a step 128 thereby waiting until the expiration of a given time. In other words, the step 128 determines whether an elapsed time computing timer has attained a given value (e.g., a value corresponding to 0.1 second) and maintains a wait state until the given value is attained. When the given value is attained, the timer is reset and the counting operating in response to the internal clocks is started. Note that since the timer has already been set to the given value by the initialization when the processing proceeds to the step 128 for the first time, the wait state is not maintained and the timer is reset thereby starting its counting operation. Then, a return is made to the step 102 of FIG. 2.

When the processing proceeds to the step 123 via the step 122 next time, since the first timer data $T_A$ is not zero, the decision of the step 123 becomes NO and a transfer is made to a step 129 which in turn subtracts the constant of 1 from the value of the second timer data $T_B$ set previously by the step 124 and transfers to a step 130. Since it is just after the beginning of the subtraction, the decision of the step 130 becomes NO and a transfer is made to the step 127 which in turn decreases and updates the first timer data $T_A$ and transfers to the step 128. Thus, the wait state is maintained until the elapsed time computing timer attains the given value. In other words, by passing the processing through the step 128, it is possible to maintain the period of the repetitive computation constant and ensure the accuracy of the elapsed time due to the subtraction of the first and second timer data $T_A$ and $T_B$, respectively.

Then, with the repetitive computation, when the time set previously by the step 124 elapses and the value of the second timer data $T_B$ decreased and updated by the step 129 is reduced to zero, the decision of the step 130 becomes YES and a transfer is made to a step 131 thereby applying a radiator passage OFF command to the electromagnetic valve driver circuit 21 and making a transfer to the step 127. Thus, the radiator-side passage **11*a* is closed and the engine-side passage 11*g* and the radiator bypassing passage 11*b*** again communicate with each other.

Thereafter, when the time passes further so that the value of the first timer data $T_A$ which is decreased and updated in response to each transfer to the step 127 is reduced to zero, the next transfer to the step 123 causes its decision to become YES and the step 124 sets the second timer data $T_B$ in accordance with the current first deviation $\Delta T_1$. Then, the step 125 sets the first timer data $T_A$ to a value corresponding to six seconds and transfers to the step 126 thereby applying a radiator passage ON command to the electromagnetic valve driver circuit 21. As a result, the radiator-side passage **11*a* and the engine-side passage 11*g*** communicate with each other.

More specifically, if the engine cooling water temperature is in the given range of temperatures, the first deviation $\Delta T_1$ is a positive value and the value of the second deviation $\Delta T_2$ is less than zero, the computational operations which proceed via the steps 122 to 128 are performed so that the radiator-side passage **11*a* and the engine-side passage 11*g* communicate with each other in response to each lapse of six seconds and upon expiration from that time of a time set according to the value of the first deviation $\Delta T_1$ the radiator bypassing passage 11*b* and the engine-side passage 11*g* are communicated with each other. These changes of the passage connection are sequentially repeated and the time during which the radiator-side passage 11*a* and the engine-side passage 11*g*** are communicated is increased with increase in the value of the first deviation $\Delta T_1$.

Then, as the engine cooling water temperature rises still further so that the value of the second deviation $\Delta T_2$ becomes positive, upon proceeding of the processing to the step 121 its decision becomes YES and a transfer is made to a step 132 which in turn applies a radiator passage ON command to the electromagnetic valve driver circuit 21 and transfers to a step 133. Thus, the speed data N of the fan motor **6*a* is set in response to the value of the second deviation $\Delta T_2$ in accordance with the illustrated characteristic relation and a transfer is made to a step 134. Thus, the speed data N is applied to the motor driver circuit 22 and the processing returns to the step 102 of FIG. 2. When this occurs, the engine cooling water is supplied to the radiator 5 and the motor-driven fan 6 is operated by the motor 6*a* thereby cooling the radiator 5**.

As long as the value of the second deviation $\Delta T_2$ is positive, the above-mentioned operations are repeated so that the communication between the radiator-side passage **11*a* and the engine-side passage 11*g* is maintained continuously and the speed of the motor-driven fan 6** is increased with increase in the value of the second deviation $\Delta T_2$ thereby further enhancing the cooling effect.

While a preferred embodiment of the invention has been described, the invention is not intended to be limited thereto and many modifications can be made thereto. Such modifications will now be described.

(1) The valve unit 11 may be not only of the type which controls the on-off cycle of the electromagnetic valve (e.g., the duty control type) but also of the type which continuously controls the opening of the valve by such means as a motor or diaphragm actuator.

(2) The drive unit 8 of the radiator shutter 7 may also use such means as a motor or electromagnetic solenoid in addition to the illustrated diaphragm actuator.

(3) Of course, the speed of the motor-driven fan 6 for supplying air to the radiator 5 may not only be controlled continuously as described above but also be subjected to multispeed control to change the speed in a stepwise manner.

(4) The radiator shutter 7 and the water pump 10 may not only be subjected to a simple on-off control but also be subjected to a control which changes the shutter position and the pump speed in a stepwise manner in case of need.

(5) While the microcomputer 18 is used to perform the software digital computational operations, a hard logic construction comprising electronic circuitry may be used to effect the various controls.

From the foregoing it will be seen that in accordance with the present invention, by virtue of the fact that the electronic control unit, e.g., the microcomputer 18 is used to control the motor-driven fan 6 for supplying air to the radiator and the electrically-controlled valve unit 11 for regulating the cooling water flowing to the radiator in accordance with the engine cooling water temperature, during the period immediately following the engine start the heat radiation of the engine cooling water (or the overcooling) is avoided as far as possible and the engine water temperature is raised quickly thereby providing a great effect of reducing the warm-up period of the engine during the winter season.

In addition to these points, the radiator shutter 7 can also be controlled by the electronic control unit to more rapidly increase the engine water temperature and thereby further reduce the warm-up period of the engine.

We claim:

1. A cooling system control apparatus for controlling the temperature of cooling water in a water-cooled engine comprising:

a radiator for cooling said engine cooling water;

a motor-driven fan for supplying air to said radiator;

an electrically controlled water pump for circulating said engine cooling water through an engine cooling system circuit including said radiator;

an electrically controlled radiator shutter positioned to open and close an air inlet of said radiator;

electrically-controlled valve means for regulating the amount of said engine cooling water flowing to said radiator;

a water temperature sensor for electrically detecting the temperature of said engine cooling water; and an electronic control unit for receiving at least an electric signal from said water temperature sensor to control the operation of said motor-driven fan, said water pump, said radiator shutter and said valve means in accordance with the temperature of said engine cooling water, such that when the engine cooling water temperature detected by said water temperature sensor rises above a first reference temperature $T_1$ representing a lowest reference temperature, said water pump is operated, and when said engine cooling water temperature rises above a second reference temperature $T_2$ higher than said first reference temperature $T_1$, said radiator shutter is operated to open the air inlet to said radiator, and at substantially said second reference temperature $T_2$ said valve means opens a water passage to said radiator, and when said engine cooling water temperature rises further exceeding a third reference temperature $T_3$ higher than said second reference temperature $T_2$, said motor driven fan is operated.

2. An apparatus according to claim 1, further comprising an electrically-controlled shutter drive means for actuating said radiator shutter to open and close, wherein said electronic control unit is responsive to said engine cooling water temperature indicative electric signal from said water temperature sensor to control the operation of said shutter drive means, said shutter drive means comprising a diaphragm actuator and an electromagnetic valve for controlling the air pressure supplied to said diaphragm.

3. An apparatus according to claim 1, further comprising a vehicle speed sensor, wherein said electronic control unit is responsive to a vehicle speed signal from said vehicle speed sensor to vary at least one of said reference water temperature $T_1$, $T_2$ and $T_3$ to correct said at least one reference temperature to a higher temperature level when the vehicle speed is high.

4. An apparatus according to claim 1, further comprising an outside air temperature sensor, wherein said electronic control unit is responsive to an outside air temperature signal from said outside air temperature sensor to vary at least one of said reference water temperatures $T_1$, $T_2$ and $T_3$ to correct said at least one reference temperature to a higher temperature level when the outside temperatures is low.

5. An apparatus according to claim 1, wherein said valve means is controlled by said electronic control unit to continuously increase the amount of water supplied to said radiator as the engine water temperature rises.

6. An apparatus according to claim 5, wherein said valve means is comprised of an electromagnetic valve and an ON-OFF cycle thereof is controlled.

7. An apparatus according to claim 6, wherein said electromagnetic valve is of the 3-way type which connects an engine-side passage to a radiator side passage or to a radiator bypassing passage.

8. An apparatus according to claim 1, wherein said motor-driven fan is controlled by said electronic control unit to continuously increase the rotational speed as the engine water temperature rises.

9. An apparatus according to claim 1, wherein said water pump is driven by a motor.

10. A cooling system control apparatus for controlling the temperature of cooling water in a water-cooled engine, wherein said water-cooled engine is mounted on an automobile equipped with a heating system which utilizes the engine cooling water as a heat source, and said heating system includes an air heating core, a blower fan for supplying the hot air heated by the heater core into a vehicle compartment, a motor for driving said blower fan, and a fan switch for switching ON and OFF the current to said motor, said cooling system control apparatus comprising:

a radiator for cooling said engine cooling water;

a motor-driven fan for supplying air to said radiator;

an electrically controlled water pump for circulating said engine cooling water through an engine cooling system circuit including said radiator and through said heating system including said air heating core;

an electrically controlled radiator shutter positioned to open and close an air inlet of said radiator;

electrically controlled valve means for regulating the amount of said engine cooling water flowing to said radiator;

a water temperature sensor for electrically detecting the temperature of said engine cooling water;

means for detecting the operating condition of said blower fan of said heating system; and an electronic control unit for receiving electrical signals at least from said water temperature sensor and said blower fan operating condition detecting means to control the operation of said motor driven fan, said water pump, said radiator shutter, and said valve means in accordance with the temperature of said engine cooling water and the operating condition of said blower fan so that when said water temperature rises above a first reference temperature $T_1$ or said blower fan of said heating system is in the operating condition, said water pump is operated, and when said water temperature rises above a second reference temperature $T_2$ higher than said first reference temperature $T_1$, said radiator shutter is operated to open the air inlet to said radiator, and at substantially said second reference temperature $T_2$ said valve means opens a water passage to said radiator, and when said water temperature rises further exceeding a third reference temperature $T_3$ higher than said second reference temperature $T_2$, said motor driven fan is operated.

* * * * *